US010260268B1

(12) United States Patent
Whitlock

(10) Patent No.: US 10,260,268 B1
(45) Date of Patent: Apr. 16, 2019

(54) GARAGE DOOR SUPPORT

(71) Applicant: STATE FARM MUTUAL AUTOMOBILE INSURANCE COMPANY, Bloomington, IL (US)

(72) Inventor: Ryan Whitlock, Clinton, IL (US)

(73) Assignee: State Farm Mutual Automobile Insurance Company, Bloomington, IL (US)

( * ) Notice: Subject to any disclaimer, the term of this patent is extended or adjusted under 35 U.S.C. 154(b) by 126 days.

(21) Appl. No.: 15/602,876

(22) Filed: May 23, 2017

(51) Int. Cl.
*E05F 7/00* (2006.01)
*E05D 13/00* (2006.01)
*E05D 15/26* (2006.01)

(52) U.S. Cl.
CPC ..... *E05F 7/00* (2013.01); *E05D 13/00* (2013.01); *E05D 15/26* (2013.01)

(58) Field of Classification Search
USPC ..... 248/550; 160/209, 201
See application file for complete search history.

(56) References Cited

U.S. PATENT DOCUMENTS 4,048,771 A * 9/1977 Thistlethwaite .... E04F 21/0015 52/127.2
4,771,988 A * 9/1988 Scroggins, Sr. ..... B66C 23/208 254/336
5,383,509 A * 1/1995 Gaffney ..... E05D 15/24 160/209
5,445,207 A * 8/1995 Romanelli ..... E05D 15/24 160/209
5,732,758 A * 3/1998 Marko ..... E06B 3/485 160/201
5,964,269 A * 10/1999 Decola ..... E06B 3/485 160/209
5,967,216 A * 10/1999 Mancini ..... E06B 9/01 160/209
6,385,916 B1 * 5/2002 Marko ..... E06B 9/02 160/201
6,408,592 B1 * 6/2002 Hourani ..... E04C 3/005 254/98
6,672,573 B2 * 1/2004 Berton ..... E04H 9/02 267/136
6,776,210 B2 * 8/2004 Wells ..... E06B 3/485 160/209
6,796,361 B1 * 9/2004 Campbell ..... E06B 3/485 160/201
7,900,683 B2 * 3/2011 DeCola ..... E06B 5/11 160/209

(Continued)

*Primary Examiner* — Monica E Millner
(74) *Attorney, Agent, or Firm* — Hovey Williams LLP

(57) ABSTRACT

A bracing system for a door having a height, a width, a periphery and adjacent surrounding structure. The bracing system includes a first anchor positioned adjacent the periphery and fixed to the surrounding structure. The bracing system also includes an anchor surface positioned on the surrounding structure adjacent the periphery substantially opposite of the first anchor. The bracing system further includes a beam fixed to the first anchor and having a distal end configured to be engaged with the anchor surface. The bracing system still further includes an actuator drivingly engaged to the beam. The actuator and the beam are configured such that activation of the actuator causes movement of the distal end with respect to the anchor surface.

19 Claims, 5 Drawing Sheets

(56) References Cited

U.S. PATENT DOCUMENTS

| | | | | |
|---|---|---|---|---|
| 8,869,460 | B2 * | 10/2014 | Krishnan | E04H 9/02 52/1 |
| 9,045,928 | B1 * | 6/2015 | Seitz | E05F 15/686 |
| 2006/0243400 | A1 * | 11/2006 | Becka, Jr. | E05D 15/165 160/201 |
| 2007/0151677 | A1 * | 7/2007 | East | E06B 3/485 160/209 |
| 2007/0215294 | A1 * | 9/2007 | Barrow | E05D 15/24 160/209 |
| 2008/0141598 | A1 * | 6/2008 | Cook | E04G 21/1841 52/127.2 |
| 2009/0183842 | A1 * | 7/2009 | DeCola | E06B 3/485 160/209 |
| 2012/0227915 | A1 * | 9/2012 | Rodriguez | E05B 65/0021 160/202 |
| 2016/0278517 | A1 * | 9/2016 | DeLorean | E04B 1/7069 |
| 2018/0213931 | A1 * | 8/2018 | Schoewe | A47B 51/00 |

* cited by examiner

GARAGE DOOR SUPPORT

FIELD OF THE INVENTION

The invention relates to a reinforced garage door and systems, apparatus and computer-implemented methods for reinforcing doors. More specifically, the invention relates to systems and methods for door reinforcement using an actuator drivingly engaged to a reinforcement beam to retract and extend the beam across the door.

BACKGROUND

Existing garage door reinforcement systems essentially alter an unreinforced door by incorporating more and/or better quality struts into the main body of the door. For instance, struts comprising stronger metal alloys, and thicker brackets forming sturdier geometries, may be built into a door at a closer spacing across the height of the door to reinforce it against bending or bowing.

However, known reinforcing struts are typically manually and/or permanently engaged with the body of the door. This type of system may require a prohibitive amount of effort for placement and removal of the reinforcing components. Such a system may also lead to excessive energy costs from moving the additional weight of reinforcement each time the door is moved, i.e., even at times when the reinforcement is unnecessary. An improved reinforcement system is needed that more closely fulfills the objectives, and conserves the resources, of users.

BRIEF SUMMARY

Embodiments of the present technology relate to a reinforced door and systems, apparatus and methods for reinforcing doors. The embodiments provide for an actuator drivingly engaged to a reinforcement beam for retraction and extension across a door. The embodiments may permit improved reinforcement—for example of garage doors—which may be selectively applied and removed dependent on need. The embodiments may also permit remote actuation of the reinforcement beam for improved response time if the need for reinforcement changes.

In an aspect of the invention, a bracing system for a door is provided. The door has a height, a width, a periphery, and adjacent surrounding structure. The bracing system includes a first anchor positioned adjacent the periphery and fixed to the surrounding structure. The bracing system also includes an anchor surface positioned on the surrounding structure adjacent the periphery substantially opposite of the first anchor. The bracing system further includes a beam fixed to the first anchor and having a distal end configured to be engaged with the anchor surface. The bracing system still further includes an actuator drivingly engaged to the beam. The actuator and the beam are configured such that activation of the actuator causes movement of the distal end with respect to the anchor surface. The system may include additional, less, or alternate apparatus or components, including that discussed elsewhere herein.

In another aspect of the invention, a reinforced garage door is provided. The door includes a plurality of vertically stacked panels adjacent surrounding structure. The panels define a peripheral margin, a height and a width of the door. The door also includes a bracing assembly. The bracing assembly includes a first anchor positioned adjacent the peripheral margin and fixed to the surrounding structure and an anchor surface positioned on the surrounding structure adjacent the peripheral margin substantially opposite of the first anchor. The door further includes a beam fixed to the first anchor and having a distal end configured to be engaged with the anchor surface. The door still further includes an actuator drivingly engaged to the beam. The actuator and the beam are configured such that activation of the actuator causes movement of the distal end with respect to the anchor surface. The door may include additional, less, or alternate components, including those discussed elsewhere herein.

In still another aspect of the invention, a computer-implemented method for reinforcing a door is provided. The method includes determining a position of a retractable reinforcement beam. The method also includes analyzing weather-related event data against an event threshold to determine a reinforcement triggering event has occurred. The method further includes automatically issuing an actuation command to an actuator drivingly engaged with the reinforcement beam in response to the determination of the reinforcement triggering event. The method may include additional, fewer, or alternative actions, including those discussed elsewhere herein, and may be implemented via one or more local or remote processors, and/or via computer-executable instructions stored on non-transitory computer-readable media or medium.

In yet still another aspect of the invention, another computer-implemented method for reinforcing a door is provided. The method includes providing a controller in communication with an actuator drivingly engaged with a retractable reinforcement beam. The method also includes providing a mobile device in communication with the controller. The method further includes issuing an actuation command, via the mobile device, to the controller for activation of the actuator and extension of the reinforcement beam across the door. The method may include additional, fewer, or alternative actions, including those discussed elsewhere herein, and may be implemented via one or more local or remote processors, and/or via computer-executable instructions stored on non-transitory computer-readable media or medium.

Advantages of these and other embodiments will become more apparent to those skilled in the art from the following description of the exemplary embodiments which have been shown and described by way of illustration. As will be realized, the present embodiments described herein may be capable of other and different embodiments, and their details are capable of modification in various respects. Accordingly, the drawings and description are to be regarded as illustrative in nature and not as restrictive.

BRIEF DESCRIPTION OF THE DRAWINGS

The Figures described below depict various aspects of devices and methods disclosed therein. It should be understood that each Figure depicts an embodiment of a particular aspect of the disclosed devices and methods, and that each of the Figures is intended to accord with a possible embodiment thereof. Further, wherever possible, the following description refers to the reference numerals included in the following Figures, in which features depicted in multiple Figures are designated with consistent reference numerals. The present embodiments are not limited to the precise arrangements and instrumentalities shown in the Figures.

The Figures depict exemplary embodiments for purposes of illustration only. One skilled in the art will readily recognize from the following discussion that alternative embodiments of the systems and methods illustrated herein may be employed without departing from the principles of the invention described herein.

DETAILED DESCRIPTION

The present embodiments described in this patent application and other possible embodiments address the need for a more versatile and responsive means for reinforcing doors including, in some embodiments, garage doors. Embodiments of the present invention include an actuator drivingly engaged to a reinforcement beam. The actuator may be activated by a controller that is responsive to at least one of: 1) data and/or instructions provided by a third party server via a communication network; 2) instructions provided by a mobile electronic device of a user via the communication network; 3) signals received from a manual touchpad or button proximate the actuator; and 4) sensor data. In an embodiment, the reinforcement beam may be selectively retracted and extended as needed, leading to maximum enjoyment of its allotted space within a garage when it is not needed, to quicker responses to changing weather events and other conditions, and to reduction in energy expenditures as compared with prior systems.

Exemplary Bracing System

Figure 1:
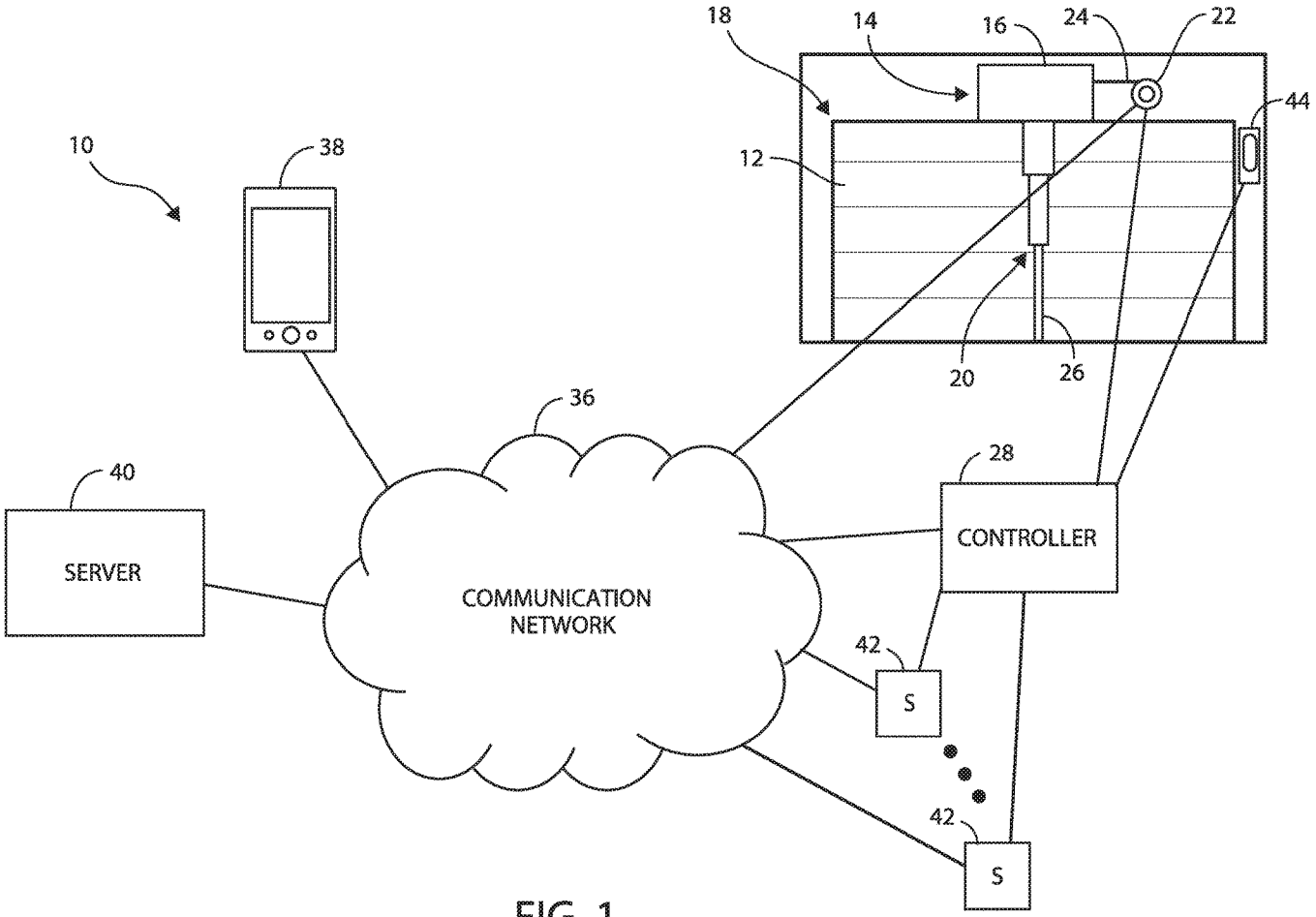
FIG. 1 illustrates a schematic view of an exemplary bracing system, constructed in accordance with various embodiments, including an actuator drivingly engaged to a reinforcement beam and in direct/indirect communication with a remote server, mobile device and sensors.

Turning now to the Figures, FIG. 1 is a schematic that illustrates an exemplary bracing system 10 for a garage door 12. The bracing system 10 includes a bracing assembly 14. The bracing assembly 14 includes a housing 16 fixed to a surrounding structure 18, and more particularly to a header portion of a wall of the surrounding structure 18. The bracing assembly 14 also includes a reinforcement beam 20 comprising a plurality of segments configured for telescoping movements with respect to one another, as described in more detail below. While a single reinforcement beam 20 is illustrated in the embodiment of FIG. 1, one having ordinary skill will appreciate that multiple reinforcement beams and bracing assemblies may be employed to reinforce a door without departing from the spirit of the present invention.

The bracing assembly 14 also includes an actuator 22 drivingly engaged to at least one segment of the beam 20 via a cable 24. The cable 24 may be fixed to a distal segment 26 of the beam 20. The actuator 22 may include a dynamoelectric machine such as a direct current or alternating current electric motor for drawing and feeding the cable 24. The actuator may also be a linear actuator according to an embodiment of the present invention. For instance, the actuator may be a mechanical actuator such as a ball screw actuator configured to convert rotary motion to linear motion. Other types of linear actuators, such as hydraulic or pneumatic actuators, are also within the ambit of the present invention.

The actuator 22 may alternatively draw or feed portions of the cable 24, respectively raising or lowering the beam 20 across the door 12 in a telescoping movement. Typically, in a raising or retracting movement, the distal segment 26 will be drawn vertically initially, followed successively by more proximal segments of the beam 20. The beam 20 may be collapsed partially or entirely to a space (not shown) within the housing 16 when fully retracted. The door 12 may remain stationary and/or move independently while the beam 20 is raised or lowered. The construction and operation of reinforcement beams according to embodiments of the present invention will be discussed in more detail below.

Figure 2:
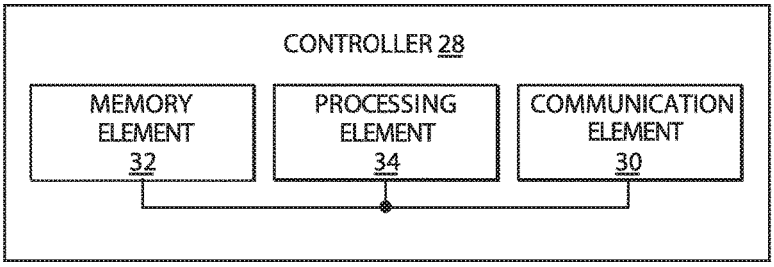
FIG. 2 illustrates an exemplary controller, shown in block schematic form, that may be used with the system of FIG. 1 to control the actuator and associated drive components and provide communication with other aspects of the system of FIG. 1.

Operation of the bracing assembly 14 may be controlled by a controller 28. Turning briefly to FIG. 2, the controller 28 may broadly comprise a communication element 30, a memory element 32, and a processing element 34. In the embodiment of FIG. 1, the system 10 also may include a communication network 36, a user mobile device 38 and a server 40. The controller 28 may exchange data and/or operational instructions with the user mobile device 38 and/or the server 40. Moreover, the system 10 may include one or more sensors 42. The controller 28 may be in communication with, and may generally send instructions to and/or receive data from, the one or more sensors 42, as discussed in more detail below.

Each of the controller 28, user mobile device 38, server 40 and sensor(s) 42 may be in communication with one or more other components of the system 10 via wired or wireless connections, or combinations thereof. For instance, the controller 28 may generally send and receive data and/or instructions through the communication network 36, respectively to and from one or more of the user mobile device 38, the server 40 and the sensor(s) 42. The communication network 36 may include local area networks, metro area networks, wide area networks, cloud networks, the Internet, and the like, or combinations thereof. The communication network 36 may be wired, wireless, or combinations thereof and may include components such as switches, routers, hubs, access points, and the like. Moreover, the sensors 42 may connect to the communication network 36 either through wires, such as electrical cables or fiber optic cables, or wirelessly, such as radio frequency (RF) communication using wireless standards such as Bluetooth® or the Institute of Electrical and Electronic Engineers (IEEE) 802.11. In one embodiment, the sensors 42 may be in wireless RF communication with each other or other sensors, with the controller 28, communication network 36, remote server 40, and/or user mobile device 38 over radio links, nodes, or access points.

Figure 3:
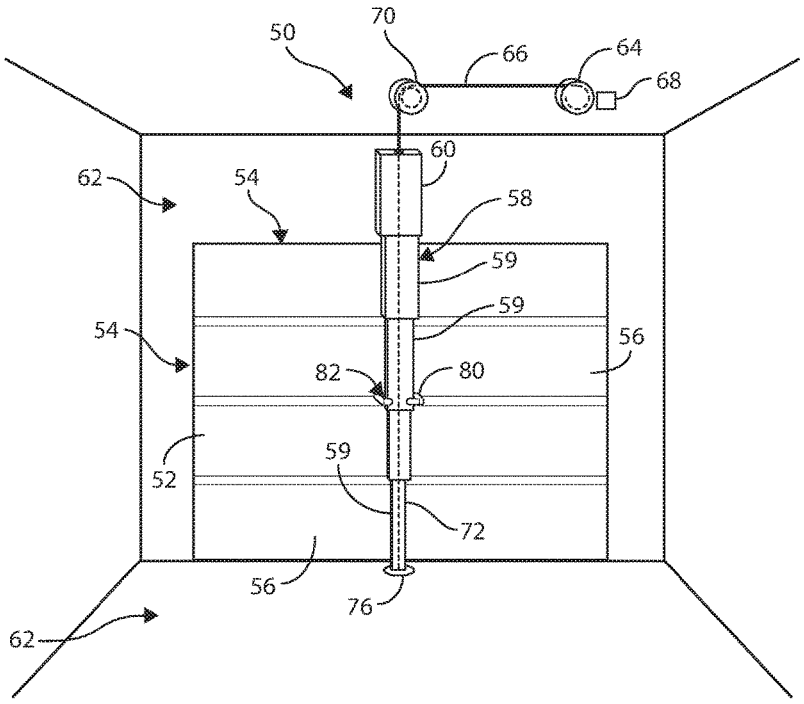
FIG. 3 is a rear perspective view of an exemplary reinforcement bracing assembly according to an embodiment that may be used with the system of FIG. 1 and that includes segments that may be retracted in a telescoping movement by an actuator.

The controller 28 may be housed locally proximate the bracing assembly 14, for example by being fixed to a portion of the surrounding structure 18 or to an adjacent building (see, e.g., controller 68 of the embodiment illustrated in FIG. 3). Alternatively or additionally, all or parts of the controller 28 may be housed remotely. For example, a remote processing element 34 and a remote memory element 32 may store data and generate commands for communication to a local communication element 30 via a communication network 36 (shown in relation to FIG. 1). The functions of the remote processing element 34 and/or remote memory element 32 may be performed by a user mobile device 38 and/or a server 40 (discussed below and shown in relation to FIG. 1). It is foreseen that the controller 28 may be alternatively configured without departing from the spirit of the present invention.

Moreover, it is foreseen that a controller 28 may comprise fewer than the aforementioned components—and may comprise or consist of other components such as a relay, contactor or similar component for signaling an actuator in response to a command—without departing from the spirit of the present invention.

The communication element 30 generally allows the controller 28 to receive data from and send data through the communication network 36. The communication element 30 may include transceivers and signal or data transmitting and receiving circuits, such as antennas, amplifiers, filters, mixers, oscillators, digital signal processors (DSPs), and the like. The communication element 30 may establish communication wirelessly by utilizing RF signals and/or data that comply with communication standards such as cellular 2G, 3G, 4G, or 5G, IEEE 802.11 standards such as WiFi, IEEE 802.16 standards such as WiMAX or Bluetooth™, or combinations thereof. In addition, the communication element 30 may utilize communication standards such as ANT, ANT+, Bluetooth™ low energy (BLE), the industrial, scientific, and medical (ISM) band at 2.4 gigahertz (GHz), or the like. Alternatively, or in addition, the communication element 30 may establish communication through connectors or couplers that receive metal conductor wires or cables which are compatible with networking technologies such as Ethernet. In certain embodiments, the communication element 30 may also couple with optical fiber cables.

The communication element 30 may be in communication with the processing element 34 and the memory element 32. The memory element 32 may include electronic hardware data storage components such as read-only memory (ROM), programmable ROM, erasable programmable ROM, random-access memory (RAM) such as static RAM (SRAM) or dynamic RAM (DRAM), cache memory, hard disks, floppy disks, optical disks, flash memory, thumb drives, universal serial bus (USB) drives, or the like, or combinations thereof. In some embodiments, the memory element 32 may be embedded in, or packaged in the same package as, the processing element 34. The memory element 32 may include, or may constitute, a "computer-readable medium." The memory element 32 may store the instructions, code, code segments, software, firmware, programs, applications, apps, services, daemons, or the like that are executed by the processing element 34. The memory element 32 may also store settings, data, documents, databases, system logs and the like.

The processing element 34 may include electronic hardware components such as processors, microprocessors (single-core and multi-core), microcontrollers, digital signal processors (DSPs), field-programmable gate arrays (FPGAs), analog and/or digital application-specific integrated circuits (ASICs), or the like, or combinations thereof. The processing element 34 may generally execute, process, or run instructions, code, code segments, software, firmware, programs, applications, apps, processes, services, daemons, or the like. The processing element 34 may also include hardware components such as finite-state machines, sequential and combinational logic, and other electronic circuits that can perform the functions necessary for the operation of the current invention. The processing element 34 may be in communication with the other electronic components through serial or parallel links that include address busses, data busses, control lines, and the like. The processing element 34 may be configured or programmed to perform the steps outlined herein through hardware, software, firmware, or combinations thereof.

The user mobile device 38 may be embodied by a smart watch, a smart phone, a personal digital assistant (PDA), a tablet, a palmtop or laptop computer, a notebook, a netbook, a smart watch, smart glasses, wearable electronics, or other mobile device, and may be typically carried by, or near, the user. A person of ordinary skill will appreciate that user mobile electronic devices of many varieties are within the ambit of the present invention. As such, the user mobile device 38 may include GPS receiver elements, memory elements, processing elements, software applications, communications elements, displays, and/or other customary components without departing from the spirit of the present invention.

The server 40 generally retains electronic data and may respond to requests to retrieve data as well as to store data. The server 40 may be embodied by application servers, database servers, file servers, gaming servers, mail servers, print servers, web servers, or the like, or combinations thereof. Furthermore, the computer server 40 may include a plurality of servers, virtual servers, or combinations thereof. The computer server 40 may be configured to include or execute software such as file storage applications, database applications, email or messaging applications, web server applications, or the like. The computer server 40 may utilize lookup tables or databases, or combinations thereof to determine weather-related data, door reinforcement historical data, or the like. The computer server 40 may include communication elements of similar composition to the communication element 30, enabling communication with other components of the bracing system 10 and/or communication over the communication network 36.

As outlined briefly above, the processing element 34, through the communication element 30, may receive data and/or commands from one or more of the memory element 32, the user mobile device 38, and the server 40. The processing element 34, through the communication element 30, may also or alternatively receive data from and/or send instructions to the one or more sensors 42.

The processing element 34 may analyze data received from the sensors 42 to determine environmental conditions, operability and/or spatial relationships relating to the position of the bracing assembly 14, door 12, surrounding structure 18 and/or nearby objects to assist in operation of the bracing assembly 14. Data received from sensors 42 may help track weather conditions and secondary conditions that may be indicative of a need or lack of a need for reinforcement of the door 12. Data received from the sensors 42 may also or alternatively inform the feasibility and/or advisability of extending or retracting the beam 20 at a given time, for example because of the presence of one or more obstructing objects and/or the occurrence of other blocking conditions. In addition, the memory element 32 may store historical data regarding operation of the bracing assembly 14 to contribute to the analyses performed by the controller 28, for example by tracking operation of the actuator 22 to provide a current status of the door 12 (e.g., "up" or "down").

More particularly, exemplary sensors 42 may detect physical states, properties and/or changes that are relevant to determination of a likely barometric pressure change or other weather event, of the position of the garage door, and/or of the presence of obstructions to operation of the bracing assembly 14. Such sensors 42 may include glass break sensors installed on a window or wall to detect when glass is broken, anemometers for detecting wind speed, barometric pressure gauges, infrared or other motion/obstruction sensors, pressure sensors and/or other similar sensors for detecting structural, weather, obstruction-related or other similar information. The sensors 42 each may include communications hardware that allow the sensors 42 to communicate, either through wires or wirelessly, with the communication element 30, which is typically located within or nearby a house associated with the bracing assembly 14. In other embodiments, each sensor 42 may also or alternatively communicate directly with the communication network 36 and/or the user mobile device 38 to provide information relevant to the need or lack of need for reinforcement of the door 12.

Further, each sensor 42 and/or the memory element 32 may record, for example with a (time of day) timestamp, when a sensed event occurred, such as when a wind condition occurred, when a glass break was detected, when an obstruction was detected, and the like. After the event occurs, and/or at predetermined time intervals, the sensor 42 may transmit event data, such as in a data packet, which includes, for example, an identification of the sensor 42, a timestamp of when the activity occurred, and an indication of the activity recorded and its magnitude, where applicable (e.g., "wind speed" and "12 mph," respectively). This event data may be transmitted to the controller 28, to the user mobile device 38 and/or to the server 40.

Upon receipt of an operational command, at predetermined time intervals, and/or continuously (i.e., upon receipt), the processing element 34 may gather, parse, organize, analyze and/or summarize sensor data and/or other event data. For example, every minute or so the processing element 34 may analyze event data regarding changing conditions and happenings in and around a structure by comparison against event threshold(s) to determine whether the data indicate a reinforcement triggering event may have occurred or is likely to occur. The processing element 34 may also or alternatively analyze the event data to determine whether additional clarity may be needed around an event or possible event, for example where additional and/or different event data may be required from the sensors 42 to track or confirm occurrence of an event.

The processing element 34 may generate operational instructions for the sensor(s) 42 based on the analysis of event data. For example, the sensor(s) 42 may be instructed on a new configuration and/or parameter/setting that will enable the collection of data required to confirm or track occurrence of a potential reinforcement triggering event. The operational instructions may be formatted for direct transmission to the sensor(s) 42 via communication network 36.

Event thresholds may be set by the processing element 34 by correlating one or more properties of event data—which may be or be derived from a sample set of data—with one or more event type(s). For example, a first event type may have one or multiple threshold(s) indicative of its occurrence. A high wind event type may be indicated by a wind speed event threshold and a barometric pressure event threshold, a severe weather alert received from the server 40 combined with a wind speed event threshold, or some other combination of received and/or sensed data. In this way, event threshold(s) may be set with reference to one or more event types and may be pre-set for periodic comparison against event data to determine if such event(s) are occurring or are likely to occur, which is described in more detail below.

As introduced above, the processing element 34 may also access and/or be provided weather data, for example average wind speed data in the surrounding area, from a database configured to store such data and be accessible to the mobile electronic device 38, controller 28 and/or the server 40. The processing element 34 may use the weather data in developing event threshold(s) and/or threshold pattern(s), may use the weather data as event data for comparison against already-set event threshold(s), and/or may use the weather data to confirm or reject a conclusion that home sensor event data indicates the occurrence or likely future occurrence of a reinforcement triggering event. Moreover, the processing element 34 may simply activate the actuator 22 in response to the occurrence of certain data—for example a severe weather alert—within the database of the server 40.

In addition to automated command of the actuator 22 according to the concepts introduced above and discussed in more detail below, the actuator 22 may be signaled by direct command of a user. The command may be issued from the mobile device 38—and more particularly via a dedicated software application running on the mobile device 38 configured to issue instructions to the bracing assembly 14 and/or to the controller 28 for operation of the bracing assembly 14—and/or from a touchpad 44 positioned within or proximate the door 12. In one embodiment, the touchpad 44 may include a video device, such as a device of one of the following types: plasma, light-emitting diode (LED), organic LED (OLED), Light Emitting Polymer (LEP) or Polymer LED (PLED), liquid crystal display (LCD), thin film transistor (TFT) LCD, LED side-lit or back-lit LCD, or the like, or combinations thereof. The controller 28 may instruct display of some or all relevant event-related data, and/or the results of its own analyses of relevant data, at the mobile device 38 and/or touchpad 44 to better inform users regarding current conditions.

Exemplary Bracing Assembly

Figure 4:
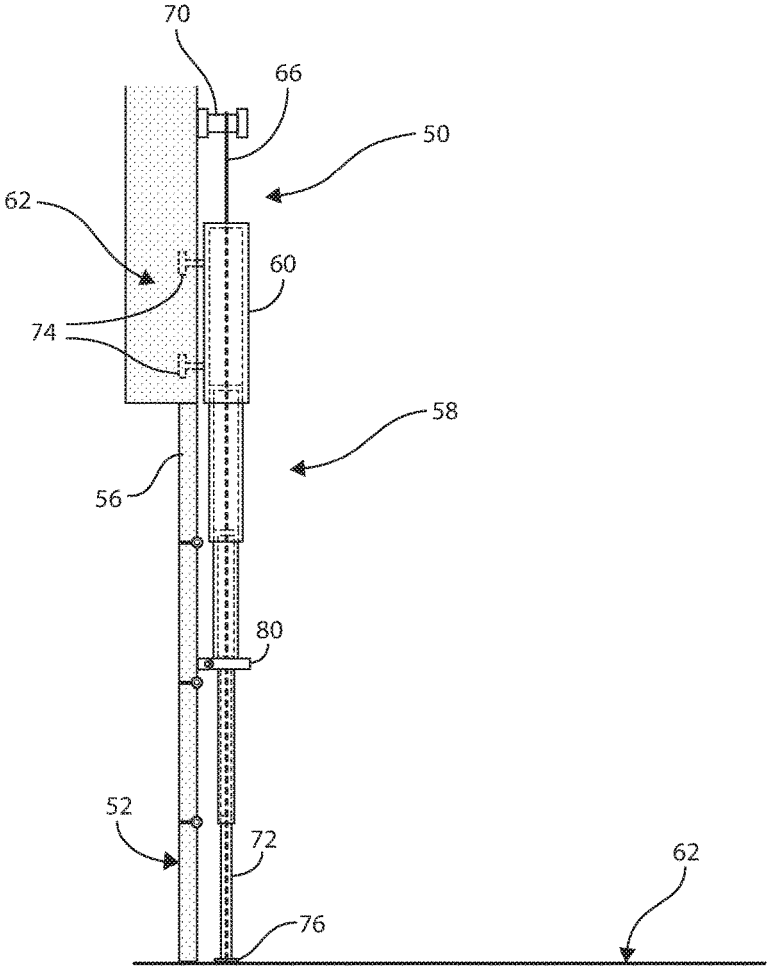
FIG. 4 is a side sectional view of the bracing assembly of FIG. 3.

Turning now to FIGS. 3 and 4, an exemplary bracing assembly 50 for reinforcement of a door 52 is illustrated.

The door 52 has a substantially rectangular peripheral margin or periphery 54 corresponding to the outside edges of a plurality of vertically-stacked and aligned panels 56 joined by a plurality of struts. The door 52 is conventionally constructed and may include brackets, hinges, rollers, tracks, etc. (in each case, not shown), and may be moved to "up" and "down" positions by an actuator that controls the ascent and descent of the door 52 (not shown). Various materials, techniques and structures that are well known in the art can be used to construct, mount, drive and guide the door 52 according to the knowledge of one having ordinary skill. Thus, these materials, techniques and structures will not be described in detail herein.

The bracing assembly 50 includes a reinforcement beam 58 having a plurality of segments 59. The plurality of segments 59 includes a first proximal segment 60 fixed to surrounding structure 62. The first proximal segment 60 serves as a housing structure for the remainder of the reinforcement beam 58, as described in more detail below. Each other segment 59 of the beam 58 is configured for telescoping movements with respect to at least one adjacent segment 59.

The bracing assembly 50 also includes an actuator 64 drivingly engaged to the reinforcement beam 58 via a cable 66. Operation of the actuator 64 is controlled by a controller 68.

The illustrated actuator 64 and cable 66 act as a winch to raise and lower the beam 58. In operation, lengths of cable 66 are either retracted onto or dispensed from a drum (not shown) of the actuator 64. One of ordinary skill will appreciate that other known drive configurations are also within the ambit of the present invention. For instance, an actuator according to embodiments of the present invention may drive an endless chain with links that engage with toothed wheels driven by the actuator to transmit power from the actuator to the reinforcement beam. Further, an actuator of a bracing assembly according to embodiments of the present invention may have an output shaft or gear that delivers power to a reinforcement beam only when rotating in one direction. In such embodiments, the bracing system may, for example, rely on gravity or the like to move the reinforcement beam in the opposite direction assuming accompanying slack is provided. Still further, one of ordinary skill would appreciate that varying intermediate drive components—such as the fixed pulley illustrated in FIGS. 3 and 4—or excluding such intermediate components altogether is within the ambit of the present invention. In one embodiment, a linear actuator may be employed to provide down force on an extended beam for added securement to surrounding structure.

The embodiment illustrated in FIGS. 3 and 4 is configured with the cable 66 extending from the actuator 64 to a fixed pulley 70 disposed above the reinforcement beam 58. The cable 66 extends downward through a central cavity (not shown) of the beam 58 to a connection (not shown) with a distal segment 72 of the beam 58. Retracting cable 66 by signaling the actuator 64 to rotate in a first direction pulls the distal segment 72 substantially vertically.

The distal segment 72 has a narrower diameter than the next adjacent segment 59 of the beam 58. During retraction, the distal segment 72 is raised into the body of the next adjacent segment 59 until a locking position is reached. The locking engagement may result from a nub or protrusion (not shown) of the distal segment 72 coming into contact with a lip (not shown) of the next adjacent segment 59. It is foreseen that a variety of structure may be employed to implement telescoping retraction and extension of a beam without departing from the spirit of the present invention. One of ordinary skill will also appreciate that locking engagement of the segments at a relative position may be achieved by a number of known structures without departing from the spirit of the present invention.

Once in locking engagement, movement of the distal segment 72 with respect to the next adjacent segment 59 of the beam 58 substantially ceases. The upward power being supplied to the distal segment 72 then lifts both the distal segment 72 and the next adjacent segment 59 together until the two come into locking engagement with a still next adjacent segment 59 in substantially the same manner as described above. This process is repeated for each subsequent segment 59 until the beam 58 is retracted into the first proximal segment 60. It is foreseen that any number of segments may form a reinforcement beam according to various embodiments without departing from the spirit of the present invention.

In this manner, the lower segments 59 of the beam 58 may be raised or retracted into the housing structure of the proximal segment 60. Upon full retraction, the segments 59 of the beam 58 may be partially or fully seated within the proximal segment 60. The fully retracted beam 58 may be retracted to a level above the door 52 so as not to form an obstruction to normal enjoyment of the door 52 and garage spaces. It is foreseen that other types of housing structure, or none at all, may be used without departing from the spirit of the present invention. For instance, a beam may be swung into a retracted position rather than or in addition to being collapsed, and such a beam may be held in a retracted position by a bracket, clip, stationary gear or shaft or the like without departing from the spirit of the present invention. Embodiments including a swinging reinforcement beam may include an actuator providing rotational power output to an endless link chain for rotating the beam about a hinge. However, other joints and drive chain assemblies for swinging a reinforcement beam are within the ambit of the present invention.

Returning to FIG. 4, the proximal segment 60 is fixed to a header portion of a wall of the surrounding structure 62 by fastener-style anchors 74. Anchors 74 may comprise screws, bolts, dowels or other fasteners embedded in or otherwise fixed to the surrounding structure 62. One of ordinary skill will appreciate that an anchor may comprise any type of fastening base—including adhesive—configured to at least temporarily secure a beam against surrounding structure to substantially reduce or prevent movement in at least one direction without departing from the spirit of the present invention.

The surrounding structure 62 may include any structure adjacent the door 52. The surrounding structure 62 may comprise permanent fixtures proximate the door. For instance, in the illustrated embodiment, the surrounding structure 62 includes the walls of the garage around the door 52 as well as the garage floor. Surrounding structure may include rigid beams extending from rafters or other structure associated with the roof in addition to the aforementioned walls and floor, for example, without departing from the spirit of the present invention. It is foreseen that surrounding structure may include a plurality of discontinuous structures and surfaces without departing from the spirit of the present invention.

The bracing assembly 50 also includes an anchor surface 76 positioned on the surrounding structure 62 adjacent the periphery 54 substantially opposite of the anchors 74. More particularly, the anchor surface 76 illustrated in FIG. 3 is presented by a friction enhancing coating—such as an elastomeric coating or pad—over the garage floor. The anchor surface 76 may be fixed to the surrounding structure 62 with adhesive or fasteners. The distal segment 72 of the beam 58 may include a complementary friction enhancing surface, for example a surface presented by a rubber cap or the like (not shown) fit over an end of the distal segment 72. Such a complementary friction enhancing surface may be extended with the distal segment 72 into firm contact with the anchor surface 76 for frictional engagement therebetween.

One of ordinary skill will appreciate that other anchor surfaces for engaging a distal segment of a beam with surrounding structure are also clearly within the ambit of the present invention. A particular anchor surface may be chosen according to specifications of a particular embodiment. An embodiment may provide for bracing a door against movement in one or more than one direction, which may inform selection of an appropriate anchor surface. For example, the illustrated anchor surface 76 may provide moderate bracing in a number of directions, particularly along a horizontal plane. In embodiments where additional securement may be desired, a distal segment of a beam may be configured with a male or female portion, and an anchor surface may be presented by a corresponding female or male structure fixed to surrounding structure. In such embodiments, engagement therebetween may secure the beam to the surrounding structure. More particularly, the anchor surface may be presented by a latch, tongue, plate or the like. Moreover, an anchor surface associated with a floor of the garage may be recessed with respect to surrounding surfaces. A recessed anchor surface in many cases may be less likely to interfere with normal enjoyment of a garage floor than would a protrusion relative to surrounding surfaces that may be viewed as an obstruction or hazard. In one embodiment, a distal beam and anchor surface are configured for releasable engagement without the need for manual intervention, permitting automated retraction of the beam upon demand.

In addition, it is foreseen that an anchor surface may simply comprise a bare surface of the surrounding structure without departing from the spirit of the present invention. For example, a beam may have a distal segment with a terminus and a rubber cap fit over the terminus. The distal segment may be pressed against a bare garage floor for frictional engagement where the rubber cap meets the floor. Such a bracing system may be particularly effective where a linear actuator is employed and is configured to press the beam against the garage floor, for example in augmentation to the downward force supplied by gravity.

In an extended position the beam 58 extends between the anchors 74 and the point of frictional engagement between the distal segment 72 and the anchor surface 76. Through the anchors 74 and the anchor surface 76, the beam 58 is at least temporarily secured against movement normal to the rear face of the door 52. Turning more particularly to FIG. 4, in its simplest form the beam 58 secures against moderate or extreme bowing of the door 52 inward in the direction of the interior of the garage, for instance in the event of a pressure buildup outside the garage. The beam 58 may simply be placed in proximity to the rear face of the door 52 such that moderate or extreme bowing of the door 52 may bring it into contact with the beam 58, which substantially prevents further bowing.

The beam 58 provides additional support in the illustrated embodiment through a brace 80 extending from the rear face of the door 52 into engagement with an intermediate segment 59 of the beam 58. The brace 80 comprises a simple rigid bar that is formed in a U shape (see FIG. 3) so that it at least partly encircles the intermediate segment of the extended beam 58. More particularly, the brace 80 is fixed to the door 52 using conventional fasteners (not shown). The brace 80 extends in two opposing arms from the rear of the door 52 to form a slot 82 generally aligned with an extension trajectory of the intermediate segment 59 of the beam 58. Upon extension, lower segments 59 of the beam 58 extend through the slot 82 until the beam 58 is fully extended and the intermediate segment 59 comes to rest within the slot 82 formed by the opposing arms of the brace 80. In this manner, inward and outward bowing of the door 52 is substantially prevented or reduced by engagement between the beam 58 and the door 52 at the brace 80.

Though a brace may be fixed to a door and extend into temporary engagement with an extended reinforcement beam, as in the embodiment described above, the reverse may be true without departing from the spirit of the present invention. For instance, a brace fixed to and extendible from a beam is within the ambit of the present invention. In such an embodiment, the brace may be automatically released, when the beam is extended, from a cavity defined in a side of an intermediate segment of the beam that faces a door. The intermediate segment may extend from encasement within a next adjacent segment of the beam, causing the brace to unfurl in tandem with the emergence of the intermediate segment. The brace may be compelled to extend from such a cavity by, for example, the force of gravity and/or may be spring loaded. The brace may also or alternatively be manually fixed to and/or deployed from the beam following extension. Likewise, a brace may be automatically or manually retracted into the cavity and/or against the body of the intermediate segment in connection with retraction of the beam.

Further, in such embodiments the brace may be temporarily fixed to the door for enhanced bracing with a pin. The pin may be deployed in conjunction with the brace. Upon extension of the beam across the door, the pin may automatically align with and fit snugly within, or may be manually inserted into, a slot of a receiving bracket fixed to the door. In this manner, the pin may stabilize the door against either inward or outward bowing.

The brace 80 may be secured within a middle third of the door 52 along a horizontal axis, and within a middle third of the door 52 along a vertical axis, to enhance the bracing effect on the door 52, and may be fixed in proximity to the center of the door 52. It is foreseen that a brace may be otherwise configured and/or positioned, and may be secured to a door by other means, without departing from the spirit of the present invention. Beams including fewer and possibly only one segment are within the ambit of the present invention, and a brace may be positioned on any segment of the beam without departing from the spirit of the present invention.

The controller 68 is illustrated inside a housing proximate the bracing assembly 50, and is fixed to a portion of the surrounding structure 62. The controller 68 is in wired connection (not shown) with the actuator 64 to provide operational commands to the actuator 64. The controller 68 may include a memory element to store, and a processing element to execute, a control application configured to perform the steps described herein and in more detail below.

Exemplary Computer-Implemented Method for Bracing

Figure 5:
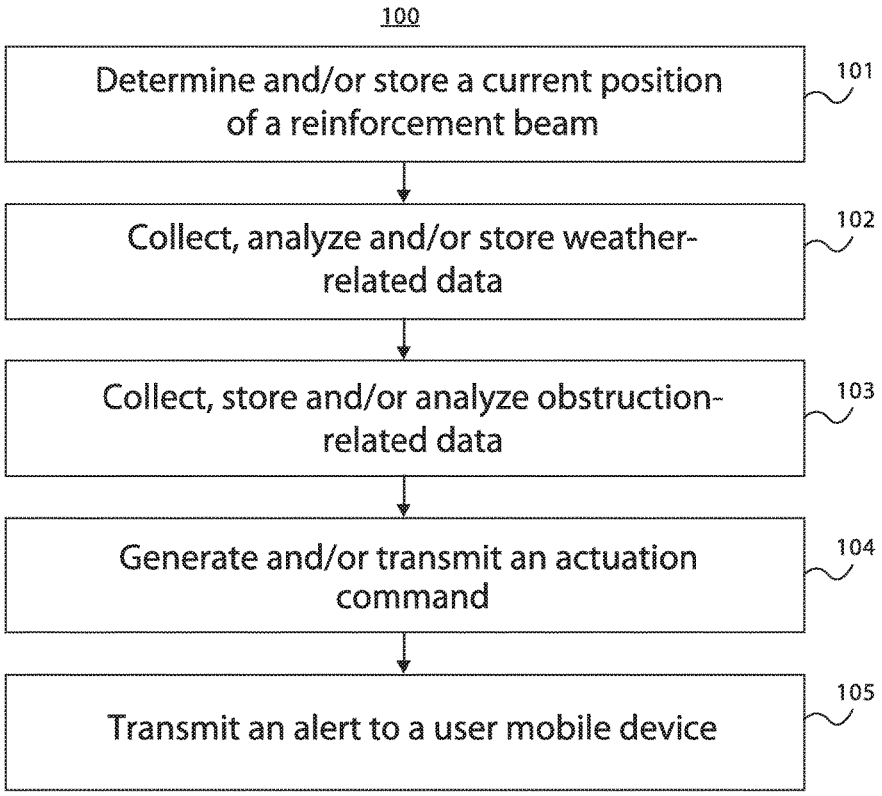
FIG. 5 illustrates at least a portion of the steps of an exemplary computer-implemented method for selectively reinforcing a door.

FIG. 5 depicts a listing of steps of an exemplary computer-implemented method 100 for remotely controlling extension and retraction of a bracing assembly. The steps may be performed in the order shown in FIG. 5, or they may be performed in a different order. Furthermore, some steps may be performed concurrently as opposed to sequentially. In addition, some steps may be optional.

The computer-implemented method 100 is described below, for ease of reference, as being executed by exemplary devices introduced with the embodiment of the system 10 illustrated in FIG. 1. However, a person having ordinary skill will appreciate that responsibility for all or some of such actions may be distributed differently among such devices or other computing devices without departing from the spirit of the present invention.

A computer-readable medium may also be provided. The computer-readable medium may include an executable program stored thereon, wherein the program instructs one or more processing elements to perform all or certain of the steps outlined herein. The program stored on the computer-readable medium may instruct the processing element to perform additional, fewer, or alternative actions, including those discussed elsewhere herein.

A controller of a bracing system may determine and/or store 101 a current position of a reinforcement beam adjacent a garage door. More particularly, a current position may be stored in a memory element of the controller. For instance, a current position value may be stored. The current position value may be binary—e.g., a "1" may indicate a fully extended position and a "0" may indicate a fully retracted position for the reinforcement beam. Intermediate positions may also be logged and stored without departing from the spirit of the present invention. Position values stored according to various data formats and logic models are clearly within the ambit of the present invention.

The current position value may be updated automatically each time the reinforcement beam is actuated to move between extended and retracted positions. In this manner, a binary current position value, for example, may simply flip-flop each time an actuation—e.g., extension or retraction—command is issued to an actuator drivingly engaged with the reinforcement beam. Similarly, a directionality for each prior instance of actuation—for instance as determined by the direction of the power output generated by the actuator—may be logged and stored for better confirmation of the current position of the reinforcement beam. Further, the position of a drive chain or other component of the bracing assembly may also or alternatively be logged and stored for determination of the current position of the reinforcement beam. Still further, the current position of the reinforcement beam may also or alternatively be determined based at least in part by sensor data. More particularly, one or more sensor(s) may be configured to detect the position of at least one part of the reinforcement beam and/or a cable or chain or the like drivingly engaged with the reinforcement beam.

It is also foreseen that a current position of the reinforcement beam may not be stored and/or determined without departing from the spirit of the present invention. For instance, the actuator may include one or more mechanical and/or electrical interlock(s) that activate, deactivate and/or switch the directionality of the actuator's output in response to certain physical triggers. For instance, such an interlock may be responsive to forces acting in opposition to the actuator's output. Such interlocks may at least in part control the directionality of the actuator's output—and therefore of the reinforcement beam's movement—in response to physical conditions rather than or in addition to commands issued by the controller based on an analysis of data or receipt of external commands. In one embodiment, an interlock may respond to an actuation command from the controller and/or another source by directing the actuator to generate output in a direction corresponding to reinforcement beam extension. In the event such initial output is met with resistance—e.g., because the beam is already extended into contact with the garage floor—an interlock may direct the actuator to reverse the direction of output to retract the reinforcement beam.

The controller may also collect, analyze and/or store weather-related data 102. As outlined above, the weather-related data may be received via a communication network from a server and/or user mobile device or other computing device. For instance, the server may administer a weather and/or emergency-alert emergency system, another publicly-accessible database dedicated at least in part to storing and disseminating weather-related data, and/or a subscription-based weather database. The server may format the weather-related data specifically for consumption by the controller in support of automated operation of the reinforcement beam, or may provide weather-related data more broadly for general consumption that is interpreted and/or converted for use by the controller of the bracing assembly.

In one embodiment, a communication element of the controller is configured for receipt of radio signals generated by the Federal Emergency Alert System. In this embodiment, the controller may also be configured to interpret data and/or messages received via such radio signals and to automatically analyze and issue operational commands to the actuator in response thereto. For instance, the controller may command the actuator to extend the reinforcement beam if the Emergency Alert System signals a severe thunderstorm of tornado warning in the county or jurisdiction in which the bracing system is located. Likewise, the controller may command the actuator to retract the reinforcement beam automatically upon expiration of a sunset for such a warning identified by the Emergency Alert System and/or upon receipt of a confirmation that the warning has been lifted. A person of ordinary skill will appreciate that a variety of data sources may be used, and the controller may be configured with a variety of automated response rules for operating the bracing system, without departing from the spirit of the present invention.

The controller may also collect and store weather-related data 102 from one or more sensors with which the controller is in communication, for example via a communication network. The sensor(s) may provide data regarding the conditions in surrounding or adjacent areas, such as barometric pressure, wind speed, water level(s), etc. The sensor(s) may also provide data regarding stresses, strains and other forces being exerted on a garage door or other type of door, or on surrounding structures. For instance, a strain gauge placed on a bracket supporting a track along which a door rides may directly provide data regarding the forces being exerted on the door in real time. It is foreseen that a variety of sensor(s) may be employed to glean relevant information from the environment regarding current conditions without departing from the spirit of the present invention.

The controller may collect, analyze and/or store weather-related data 102 on a rolling basis—for instance whenever the data are reported by the server and/or sensor(s)—and/or may periodically issue requests for such data. The weather-related data may be expunged from the memory element of the controller, and/or disregarded in analyses by the controller, periodically without departing from the spirit of the present invention.

The controller may also collect, store and/or analyze obstruction-related data 103. The obstruction-related data may be obtained from one or more sensor(s) proximate the door over which the reinforcement beam is configured to extend/retract. For instance, an infrared sensor may be positioned so as to detect any objects which may be in the path of extension of the reinforcement beam.

The controller may collect, store and/or analyze obstruction-related data 103 on a rolling basis—for instance whenever the data are reported by the sensor(s)—and/or may periodically issue requests for such data, such as whenever an actuation command is generated/received. The obstruction-related data may be expunged from the memory element of the controller, and/or disregarded in analyses by the controller, periodically without departing from the spirit of the present invention.

The controller may also generate and/or transmit one or more actuation commands 104 directing operation of the actuator for extension or retraction of the reinforcement beam. The commands may be generated remotely and routed through the controller and/or may be generated by the controller in response to data indicating an event, as described in more detail below. In the former scenario, the server may transmit a weather alert to the controller, causing the controller to generate and/or analyze the feasibility of implementing an extension command for the reinforcement beam, as described in more detail below. The server and/or user mobile device may alternatively issue a properly-formatted command for transmission to the actuator, which may be simply routed through the controller, without departing from the spirit of the present invention. In the latter scenario introduced above, the controller may analyze data substantially in accordance with the following description to determine occurrence of a reinforcement triggering event warranting extension or retraction of the reinforcement beam.

Analysis of weather-related data to determine occurrence of an event warranting actuation of the reinforcement beam may be carried out by one or a combination of the controller, server and user mobile device. In one embodiment, an event threshold and/or threshold pattern may be determined and set in association with one or more event types by the processing element of the controller. Event thresholds may be set by correlating one or more properties of event data—which may be or be derived from a sample set of data—with one or more event type(s). A sample data set may include data generated by the sensor(s) described herein. Alternatively or in addition, a sample data set may be received from an external database, such as a database of the server storing weather-related data from a previous occurrence of a reinforcement triggering event. For example, a first event type may have one or multiple threshold(s) indicative of its occurrence. A hurricane event type may be indicated by a wind speed event threshold and a barometric pressure event threshold. Alternatively, a hurricane event type may be indicated by a single event threshold comprising a combination of these two properties, such as a weighted sum of the two properties. In this way, event threshold(s) may be set for one or more event types and may be pre-set for comparison against event data to determine if such event(s) are occurring or are likely to occur.

Event threshold(s) may also be finely tuned by the processing element into a threshold pattern with reference to a particular collection of sensor(s). For example, where a network of sensor(s) of known type and location are included in a sensor network feeding data to the controller, it may be possible to analyze prior data from that area collected during occurrence of a confirmed prior event to determine a threshold pattern for event data. The threshold pattern should, of course, allow for error and natural variation, but should otherwise be finely tuned to recognize a series and set of conditions that commonly unfold during the occurrence of particular event type(s) in that area.

Such fine tuning may optionally be implemented in conjunction with and/or through execution of a machine learning program. The machine learning program may include curve fitting, regression model builders, convolutional or deep learning neural networks, Bayesian machine learning techniques, or the like. The machine learning program may associate patterns from home sensor data and/or other weather-related data with known events to inform generation of data receipt patterns and/or event threshold(s), iteratively improve the form and contents of responses and/or operational instructions to sensors through analyzing data regarding the efficacy of such measures over multiple events, and the like.

For instance, a confirmed hurricane event recorded in weather-related data stored in step 102 may generate winds of one hundred to one hundred and twenty miles per hour (100-120 mph) measured at a nearby house. The nearby house may, for example, be down the street from a house at which a bracing assembly according to an embodiment of the present invention is installed. However, strain sensor(s) associated with the garage door reinforced by the bracing system may have recorded strains during the same timeframe corresponding to lower wind speeds. If such disparities are consistently experienced across a number of events, the controller may, for example, assume that natural wind blocks protect the door reinforced by the bracing assembly. Accordingly, the controller may reduce the weighting given data sensed at the nearby house and/or broader weather alerts issued for the surrounding area. The adjusted weightings may be used in analyses of future event data against event threshold(s) to determine reinforcement triggering events. Weather data accumulated from other sources may also be used to adjust event threshold(s) and associated rules, for example data regarding average wind speed in tornadic conditions as published by the National Weather Service and/or otherwise obtained from a database configured to store such data.

The weather data may be used in developing event threshold(s) and/or threshold pattern(s), may be used as event data for comparison against already-set event threshold(s), and/or may be used to confirm or reject a conclusion that home sensor event data indicates the occurrence or likely future occurrence of a reinforcement triggering event. More particularly, event data may be analyzed with reference to an event threshold and/or threshold pattern to determine that the threshold has been exceeded. For example, event data from a sensor and/or from a weather-related database may indicate a particular wind speed was recorded at a specified location. This wind speed event data may be compared periodically or upon receipt by the controller with an event threshold including the property of wind speed as being indicative of at least one event type, alone or in combination with other properties. If the recorded wind speed from the event data meets or exceeds such an event threshold, the controller may determine that an automated response—such as actuation of the reinforcement beam—should be generated, and/or it may seek to confirm the determination using a "supplemental," and possibly independent, source of information as described in further detail below.

Metadata regarding certain types of event data may also be collected, for example data regarding the construction of a house and/or sensor placement therein with reference to its layout. This may help to provide context for interpretation of event data. For example, knowing the direction a window is facing with reference to a wind gust, the type of window installed, and perhaps the age of the structure, may inform a comparison of event data against event threshold(s), e.g., by providing context for analyzing event data indicating a glass break correlated with the wind gust. Such metadata may be collected from external databases, such as databases managed by service and/or materials providers, home alarm companies, builders, and others.

Based on the data gathering and analyses outlined above, an automated response to a reinforcement triggering event may be automatically generated, and may be embodied in a reinforcement assembly actuation command. Where an actuation command is generated or received, the processing element of the controller may analyze stored data and/or collect additional data regarding the current position of the reinforcement beam and/or the presence of any obstructions to extension/retraction.

For example, the processing element may receive a wind speed or barometric pressure change alert from one or more sensors, triggering generation of an actuation command. However, data from sensors and/or historical operation data may indicate that the door is not presently in a "down" or "closed" condition, that the beam is presently extended, and/or that the path of the beam is presently obstructed, in each case preventing issuance or implementation of the actuation command. The processing element may then enter a monitoring mode whereby the aforementioned conditions are continually monitored until each reaches a value or condition indicating that the beam may safely and effectively be extended for reinforcement and/or that the environmental condition necessitating the beam has passed.

In the alternative, the actuation command instructing extension of the beam in response to event data meeting an event threshold indicating a reinforcement triggering event may be carried out immediately if the blocking conditions described above are not present. More particularly, generation of an actuation command may trigger analysis by the controller that indicates the garage door is presently down, the reinforcement beam is presently retracted, and that no obstructions presently prevent extension of the beam. In such a scenario, the actuation command may be transmitted to the actuator and the reinforcement beam extended to reinforce the door.

The bracing system may also transmit alerts to the user mobile device 105 relating to operation of the bracing assembly. For instance, the controller may issue confirmation requests when automated processes indicate a reinforcement or retraction-triggering event has occurred, and may also transmit underlying data that led to such determination. A user of the bracing assembly may remotely review such relevant data and/or signal his/her assent to or disapproval of the extension or retraction of the reinforcement beam recommended by the automated processes of the bracing assembly prior to issuance of an actuation command to the actuator.

Moreover, the bracing system may issue alerts for display at the user mobile device if an actuation command—whether generated according to automated processes of the controller or received from the mobile device or server for implementation by the controller—has failed to be implemented, for example because of an obstruction preventing extension of the reinforcement beam. In one embodiment, the controller may transmit a message indicating an attempted actuation command has failed and the reason it has not yet been carried out. The message may additionally indicate the current settings of the bracing system with respect to ongoing attempts to carry out (e.g., monitor until the condition preventing implementation changes) and/or abandon implementation of the actuation command. The message or a derivative thereof may be displayed at the user mobile device, and the user may change the proposed course of action and/or otherwise alter system settings as desired.

Additional Considerations

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Although the present application sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of routines, subroutines, applications, or instructions. These may constitute either software (e.g., code embodied on a machine-readable medium or in a transmission signal) or hardware. In hardware, the routines, etc., are tangible units capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as computer hardware that operates to perform certain operations as described herein.

In various embodiments, computer hardware, such as a processing element, may be implemented as special purpose or as general purpose. For example, the processing element may comprise dedicated circuitry or logic that is permanently configured, such as an application-specific integrated circuit (ASIC), or indefinitely configured, such as an FPGA, to perform certain operations. The processing element may also comprise programmable logic or circuitry (e.g., as encompassed within a general-purpose processor or other programmable processor) that is temporarily configured by software to perform certain operations. It will be appreciated that the decision to implement the processing element as special purpose, in dedicated and permanently configured circuitry, or as general purpose (e.g., configured by software) may be driven by cost and time considerations.

Accordingly, the term "processing element" or equivalents should be understood to encompass a tangible entity, be that an entity that is physically constructed, permanently configured (e.g., hardwired), or temporarily configured (e.g., programmed) to operate in a certain manner or to perform certain operations described herein. Considering embodiments in which the processing element is temporarily configured (e.g., programmed), each of the processing elements need not be configured or instantiated at any one instance in time. For example, where the processing element comprises a general-purpose processor configured using software, the general-purpose processor may be configured as respective different processing elements at different times. Software may accordingly configure the processing element to constitute a particular hardware configuration at one instance of time and to constitute a different hardware configuration at a different instance of time.

Computer hardware components, such as communication elements, memory elements, processing elements, and the like, may provide information to, and receive information from, other computer hardware components. Accordingly, the described computer hardware components may be regarded as being communicatively coupled. Where multiple of such computer hardware components exist contemporaneously, communications may be achieved through signal transmission (e.g., over appropriate circuits and buses) that connect the computer hardware components. In embodiments in which multiple computer hardware components are configured or instantiated at different times, communications between such computer hardware components may be achieved, for example, through the storage and retrieval of information in memory structures to which the multiple computer hardware components have access. For example, one computer hardware component may perform an operation and store the output of that operation in a memory device to which it is communicatively coupled. A further computer hardware component may then, at a later time, access the memory device to retrieve and process the stored output. Computer hardware components may also initiate communications with input or output devices, and may operate on a resource (e.g., a collection of information).

The various operations of example methods described herein may be performed, at least partially, by one or more processing elements that are temporarily configured (e.g., by software) or permanently configured to perform the relevant operations. Whether temporarily or permanently configured, such processing elements may constitute processing element-implemented modules that operate to perform one or more operations or functions. The modules referred to herein may, in some example embodiments, comprise processing element-implemented modules.

Similarly, the methods or routines described herein may be at least partially processing element-implemented. For example, at least some of the operations of a method may be performed by one or more processing elements or processing element-implemented hardware modules. The performance of certain of the operations may be distributed among the one or more processing elements, not only residing within a single machine, but deployed across a number of machines. In some example embodiments, the processing elements may be located in a single location (e.g., within a home environment, an office environment or as a server farm), while in other embodiments the processing elements may be distributed across a number of locations.

Unless specifically stated otherwise, discussions herein using words such as "processing," "computing," "calculating," "determining," "presenting," "displaying," or the like may refer to actions or processes of a machine (e.g., a computer with a processing element and other computer hardware components) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the invention has been described with reference to the embodiments illustrated in the attached drawing figures, it is noted that equivalents may be employed and substitutions made herein without departing from the scope of the invention as recited in the claims.

I claim:

1. A bracing system for a door having a height, a width, a periphery and adjacent surrounding structure, the bracing system comprising:

a first anchor positioned adjacent the periphery and fixed to the surrounding structure;

an anchor surface positioned on the surrounding structure adjacent the periphery substantially opposite of the first anchor;

a beam fixed to the first anchor and having a distal end configured to be engaged with the anchor surface; and an actuator drivingly engaged to the beam, said actuator and said beam being configured such that activation of the actuator causes— movement of the distal end with respect to the anchor surface, movement of the beam alternatingly into and out of bracing engagement with the door.

2. The bracing system according to claim 1, wherein the bracing engagement with the door is provided via a brace fixed to the door and releasably engaged with an intermediate portion of the beam.

3. The bracing system according to claim 2, wherein— the height of the door extends along a substantially vertical axis and the width of the door extends along a substantially horizontal axis, the brace is coupled to the door to substantially reduce movement orthogonal to the vertical axis and to the horizontal axis.

4. The bracing system according to claim 1, wherein the actuator is drivingly engaged to the distal end such that activation of the actuator causes a telescoping movement of the distal end with respect to an adjacent portion of the beam.

5. The bracing system according to claim 4, wherein the actuator is drivingly engaged to the distal end of the beam by a cable that drives movement of the distal end away from the anchor surface.

6. The bracing system according to claim 1, wherein the distal end is frictionally engaged with the anchor surface when the beam is in an extended position.

7. The bracing system according to claim 1, wherein at least a portion of the beam extends behind a middle third of the width of the door.

8. The bracing system according to claim 7, wherein at least a portion of the beam extends behind a middle third of the height of the door.

9. The bracing system according to claim 1, wherein the actuator is configured to retract the distal end of the beam to a position substantially above the door.

10. The bracing system according to claim 1, wherein the actuator is activated in response to depression of a touchpad in wired connection with the actuator.

11. The bracing system according to claim 1, wherein the actuator is activated by a controller including a communication element.

12. The bracing system according to claim 11, wherein the controller is configured to activate the actuator based on instructions received via communication network from a mobile electronic device.

13. The bracing system according to claim 11, wherein the controller is configured to automatically activate the actuator based on instructions received from a third party server.

14. The bracing system according to claim 11, wherein the controller is configured to query a third party server for information relating to weather conditions and to automatically activate the actuator if the information obtained meets one or more event threshold(s).

15. The bracing system according to claim 14, wherein the controller periodically queries the third party server at preset intervals.

16. The bracing system according to claim 14, further comprising a sensor configured to sense weather-related data for automated activation of the actuator.

17. The bracing system according to claim 16, wherein the sensor is a barometric sensor.

18. A computer-implemented method for reinforcing a door, the computer-implemented method comprising, via one or more processors or transceivers:

determining a position of a retractable reinforcement beam;

analyzing weather-related event data against an event threshold to determine a reinforcement triggering event has occurred;

analyzing obstruction-related data to determine absence of physical obstruction to a path of the beam; and automatically issuing an actuation command to an actuator drivingly engaged with the reinforcement beam in response to the determination of the reinforcement triggering event and determination of absence of physical obstruction to the path of the beam.

19. A reinforced garage door comprising:

a plurality of vertically stacked panels adjacent surrounding structure, the panels defining a peripheral margin, a height and a width of the door;

a bracing assembly including— a first anchor positioned adjacent the peripheral margin and fixed to the surrounding structure;

an anchor surface positioned on the surrounding structure adjacent the peripheral margin substantially opposite of the first anchor;

a beam fixed to the first anchor and having a distal end configured to be engaged with the anchor surface; and an actuator drivingly engaged to the beam, said actuator and said beam being configured such that activation of the actuator causes— movement of the distal end with respect to the anchor surface, movement of the beam alternatingly into and out of bracing engagement with the door.

* * * * *